US006094964A

United States Patent [19]

Estrate

[11] Patent Number: 6,094,964

[45] Date of Patent: Aug. 1, 2000

[54] AUTOMOBILE FRAME MACHINE

[76] Inventor: Evan A Estrate, 501 Franklin St., Alexandria, Va. 22314

[21] Appl. No.: 09/131,654

[22] Filed: Aug. 10, 1998

[51] Int. Cl.[7] ..... B21D 1/12

[52] U.S. Cl. ..... 72/457; 72/705; 182/91; 182/92

[58] Field of Search ..... 72/457, 705; 182/90, 182/91, 92

[56] References Cited

U.S. PATENT DOCUMENTS

| | | | |
|---|---|---|---|
| Re. 31,636 | 7/1984 | Chisum . | |
| 1,407,517 | 2/1922 | Churchward . | |
| 1,953,298 | 4/1934 | Goodwin | 182/91 |
| 2,746,664 | 5/1956 | Strmic . | |
| 2,922,683 | 1/1960 | Schmertz . | |
| 3,630,066 | 12/1971 | Chisum . | |
| 3,817,074 | 6/1974 | Crosthwaite . | |
| 3,841,759 | 10/1974 | Turner . | |
| 4,057,125 | 11/1977 | Kroft . | |
| 4,530,232 | 7/1985 | Smith | 72/705 |
| 5,058,286 | 10/1991 | Chisum . | |
| 5,111,680 | 5/1992 | Ballard et al. . | |
| 5,189,898 | 3/1993 | Hamilton . | |
| 5,533,378 | 7/1996 | Boeck et al. . | |

FOREIGN PATENT DOCUMENTS

| | | | |
|---|---|---|---|
| 1484009 | 6/1967 | France | 72/705 |
| 27 39 528 | 3/1979 | Germany | 72/705 |

*Primary Examiner*—Lowell A. Larson
*Attorney, Agent, or Firm*—Harold H. Dutton, Jr.

[57] ABSTRACT

An automobile frame machine includes a platform, one or more pull towers pivotally connected about a vertical axis fixed to the platform, and a step assembly which provides simple access to the platform of the frame machine at a strategic location near one of the pull towers. The step assembly may be hingedly or rigidly secured to a side face of the pull tower arm portion, or alternatively, may be secured as an overlay atop the top and side faces of the pull tower arm portion.

5 Claims, 4 Drawing Sheets

AUTOMOBILE FRAME MACHINE

BACKGROUND AND SUMMARY OF THE PRESENT INVENTION

The present invention relates to automobile frame machines, and more particularly to an automobile frame machine having a step system for improving the process of ascending and descending from the frame machine platform.

Previous devices related to step systems and/or automobile frame machines are described in the following U.S. Pat. No. 1,407,517 to Churchward; U.S. Pat. No. 2,746,664 to Strmic; U.S. Pat. No. 2,922,683 to Schmertz; U.S. Pat. No. 3,630,066 to Chisum; U.S. Pat. No. 3,817,074 to Crosthwaite; U.S. Pat. No. 3,841,759 to Turner; U.S. Pat. No. 4,057,125 to Kroft; RE U.S. Pat. No. 31,636 to Chisum; U.S. Pat. No. 5,058,286 to Chisum; U.S. Pat. No. 5,111,680 to Ballard et al.; U.S. Pat. No. 5,189,898 to Hamilton; and U.S. Pat. No. 5,533,378 to Boeck et al.

By the present invention, there is provided an automobile frame machine having a platform, one or more pulling towers pivotally mounted about a vertical axis secured to the platform, and a step system which allows simple access to the platform at a strategic location near one of the pulling towers of the frame machine. A common problem with past frame machines is that it is difficult for a mechanic to mount the frame machine platform in order to do work on the platform without placing an object on the floor adjacent the frame machine to act as an intermediate step. As a result, mechanics must spend time locating and retrieving steps, boxes, or other available items in order to safely mount and dismount the frame machine platform. This process is especially frustrating for the mechanic carrying tools and equipment needed for the work atop the frame machine platform. Additionally, objects placed adjacent a frame machine often disrupt the movement of the pulling towers and/or become damaged when the pulling towers are rotated about the frame machine.

It is therefore one object of the present invention to provide an automobile frame machine having a platform and a step system which allows simple access to the platform.

It is another object of the present invention to provide an automobile frame machine having a step system which obviates the need for separate steps, boxes, or other objects which are used to mount and dismount the frame machine platform.

It is a further object of the present invention to provide an automobile frame machine having a platform and an easily located step system for accessing the platform.

It is still another object of the present invention to provide an automobile frame machine having a platform, one or more pulling towers pivotally secured to a vertical axis mounted to the platform, and a step system secured to a pulling tower in such a way as to allow full range of motion of the pulling tower.

DETAILED DESCRIPTION OF THE PREFERRED EMBODIMENTS

Figure 1:
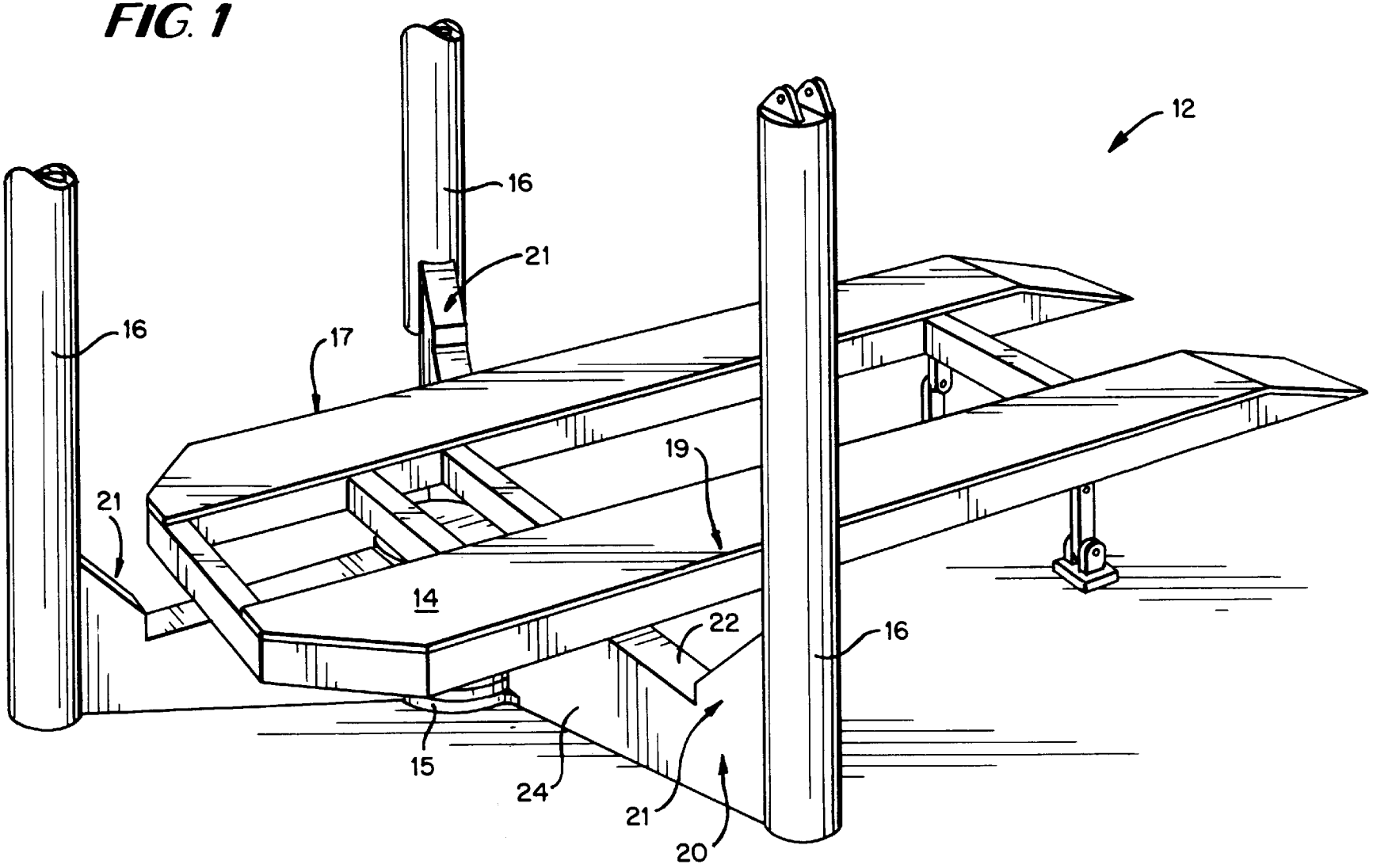
FIG. 1 is a perspective view of several components of an automobile frame machine as described in the present invention.
Figure 5:
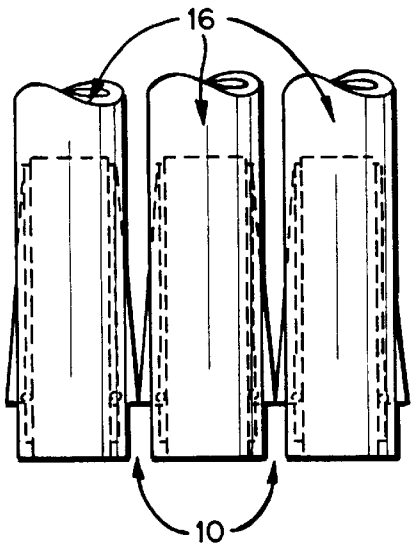
FIG. 5 is a side view of the step assembly of the present invention as applied to a plurality of pull towers.
Figure 4:
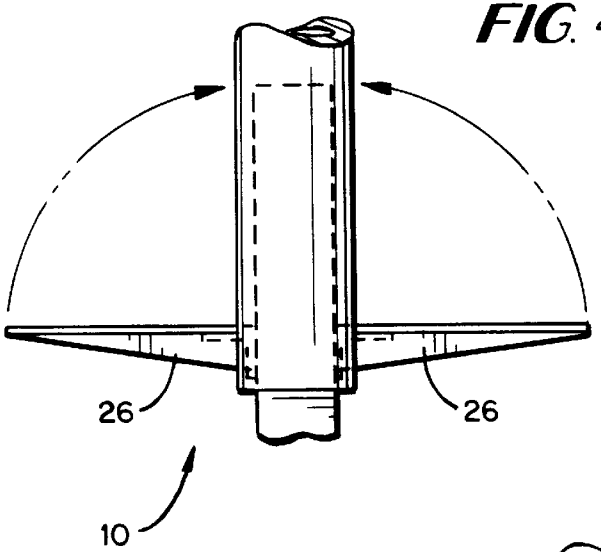
FIG. 4 is a side view of the step assembly of the present invention.

As shown in FIG. 1, there is provided an automobile frame machine 12 having a platform 14 and a plurality of vertical pull towers 16 pivotally connected about a vertical axis 15 fixed to the platform 14 and the surrounding support surface 18. Each pull tower 16 is rotatably movable to a desired position relative to a vehicle body which can be placed upon the platform 14 when in need of repairs. Each pull tower 16 includes a generally horizontally disposed arm portion 20 having a top surface 22 and a pair of side surfaces 24. There is sufficient distance between the top surface 22 of each pull tower arm portion 20 and the platform 14 in order to allow each tower to rotate through a full range of motion from a first side 17 of the platform to a second side 19 opposite the first side. Each tower arm portion 20 further includes a corner portion 21 which, for the outermost pull towers, will contact the platform 14 at one end of the range of motion of the respective outermost pull tower 16. The pull towers 16 may be positioned apart from one another, as shown in FIG. 1, or may be pooled together so as to stand closely adjacent one another, as shown in FIG. 5.

As shown in FIGS. 2 through 8, a step assembly 10 is provided which may be secured to the tower arm portion 20 of any or all of the pull towers employed. The step assembly 10 provides a flat step member 26 extending from a position adjacent at least one of the side surfaces 24 of the pull tower arm portion 20 so as to allow a user simple access to and from the frame machine platform. By securing the step system to the tower arm portion of the present invention, the user can quickly locate the step member from any position relative to the frame machine simply by locating a pull tower.

Figure 2:
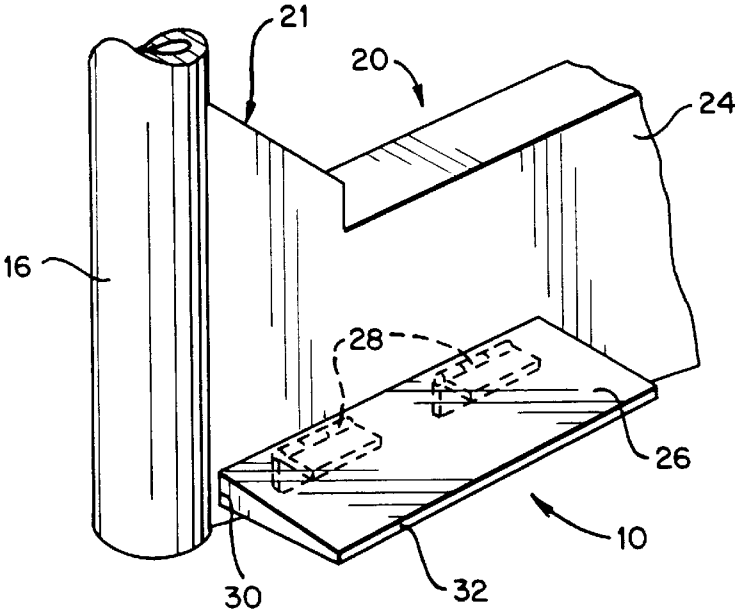
FIG. 2 is a perspective view of the step assembly of the present invention, showing a step member in the open position.
Figure 3:
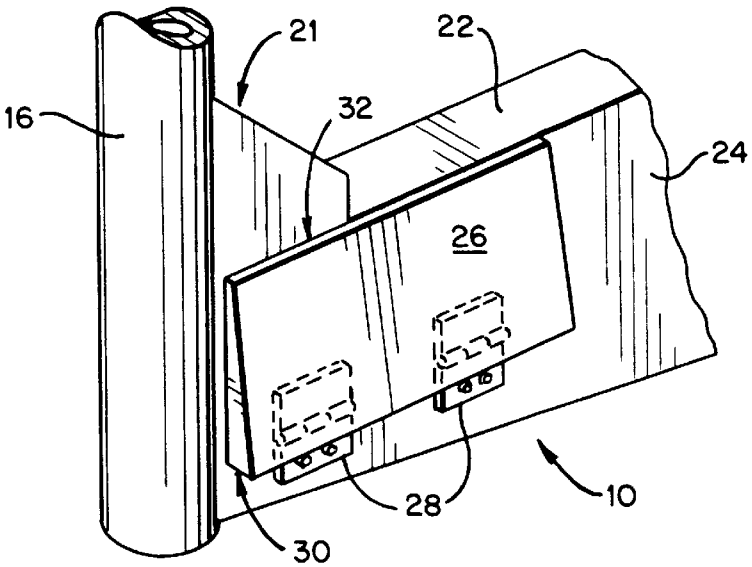
FIG. 3 is a perspective view of the step assembly of the present invention, showing a step member in the retracted or upward position.
Figure 7:
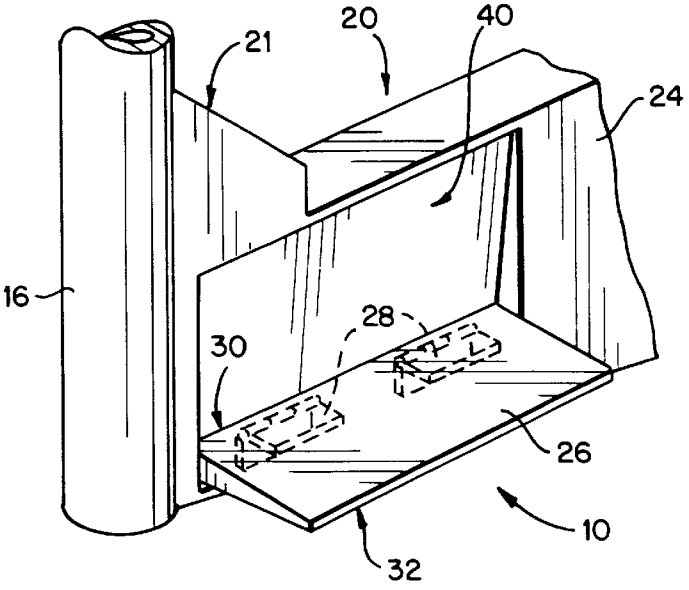
FIG. 7 is a perspective view of a further embodiment of the step assembly of the present invention, showing a step member in the open position.
Figure 8:
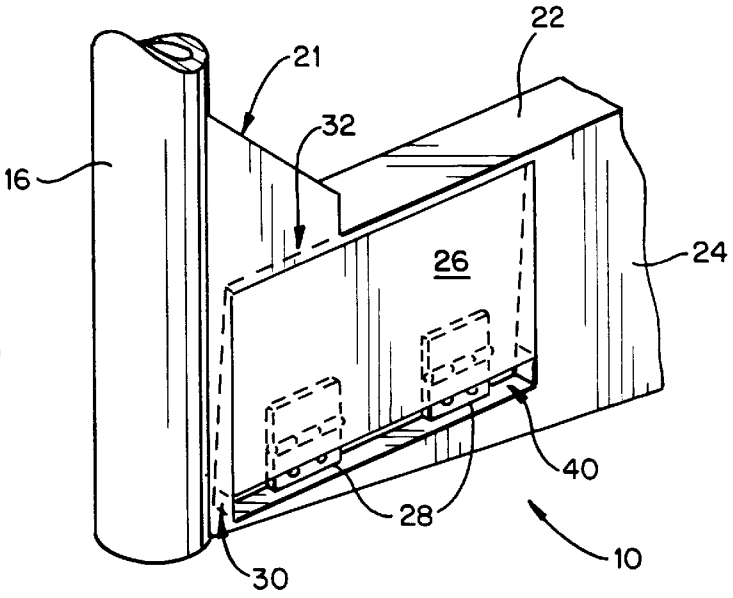
FIG. 8 is a perspective view of the step assembly of FIG. 7, showing a step member in the retracted or upward position.

In the embodiment of the invention as shown in FIGS. 2 through 5 and FIGS. 7 and 8, the step member 26 is secured to the side surface 24 by hinges 28. This allows the step member 26 to be placed in the open position substantially perpendicular to the side surface 24 for use, as shown in FIGS. 2 and 7, or retracted to a closed position substantially parallel to and closely adjacent the side surface 24 of the tower arm portion 20 when not in use, as shown in FIG. 3. In the embodiment of the invention as shown in FIGS. 7 and 8, the tower side surface 24 is provided with an indentation 40 for receiving the step member 26. Indentation 40 allows the step member 26 to lie substantially coplanar with the side surface 24 when the step member is in the retracted position. The hinges, combined with the weight of the step member, are sufficient to retain the step member in the retracted position for as long as desired. In one embodiment, a single hinge extending the width of step member 26 is employed. The hinges 28 may be secured by screws, for example, extending through the hinge plate into the side face 24 of the tower arm portion 20.

In the retracted position as shown in FIGS. 3 and 8, the step assembly 10 maintains a profile even with or below the top surface 22 of the pull tower arm portion 20 and thereby does not interfere with the movement of the pull towers 16 as they are pivoted about the vertical axis of the frame machine. Further, as shown in FIGS. 3 and 8, the step assembly in the retracted position does not significantly interfere with the relative positioning of the pull towers 16 during the use of the frame machine to repair a vehicle body. Thus, as shown in FIG. 5, the step system 10 of the present invention may be applied to both side faces of each pull tower 16 without significantly hindering the relative positioning of the pull towers 16. In the embodiment of the invention as shown in FIGS. 7 and 8, the step member 26 in the retracted position provides no hindrance to the positioning of the pull towers 16.

As shown in FIGS. 2 through 5 and in FIGS. 7 and 8, the step member 26 is secured to the radially outer portion of the tower arm portion 20, and therefore partially lies below the tower arm corner portion 21. This arrangement allows the step member 10 to be available for use regardless of the platform-relative location of the pull tower 16 to which it is secured. For example, when one of the outermost pull towers is positioned at one of the ends of its range of motion, such as where the tower arm corner portion, 21 contacts the platform 14, at least a portion of the step member 26 will extend outward from below the platform so as to be available for use in ascending or descending from the platform.

The step member 26 may be formed of metal or other rigid material which is formed such that the base portion 30 near the side surface 24 of the tower arm portion has the greatest width and the tip portion 32 has the smallest width. This arrangement provides the step system with sufficient stability to withstand the weight of individuals carrying heavy loads to and from the frame machine, for example. Further, the width of the step member 26 is such that the step member will not interfere substantially with the positioning of the towers adjacent one another, as shown in FIG. 5.

Figure 6:
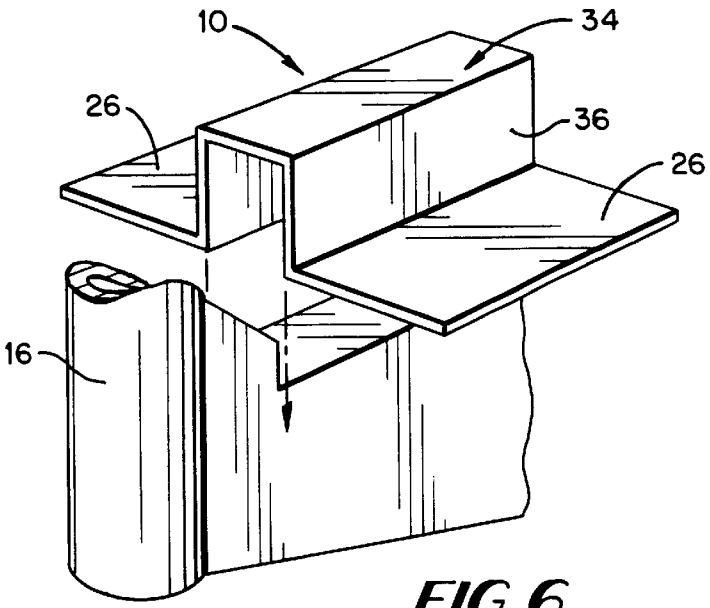
FIG. 6 is a perspective view of an alternative embodiment of the step assembly of the present invention.

In the embodiment of the invention as shown in FIG. 6, the step assembly 10 includes a top portion 34, side wall portions 36, and step members 26. The top 34 and side wall 36 portions are adapted so as to fit securely against the top 22 and side 24 surfaces, respectively, of the tower arm portion 20. When the step assembly of FIG. 6 is in position, the step members 26 extend from both side faces 24 of the tower arm portion 20. The step assembly 10 of FIG. 6 may be placed upon the tower arm portion in snug relation, or alternatively may be secured to the frame machine by screws extending through the top 34 or side wall 36 portions into the tower arm portion 20. The top portion 34 of the step assembly of FIG. 6 is sufficiently sized so as to allow the pull tower arm portion 20 to maintain clearance of the platform 14 as the pull tower rotates about the platform vertical axis. The step assembly as shown in FIG. 6 may be formed of metal or a durable plastic, for example.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An apparatus for repairing and straightening a vehicle body, comprising:

a platform system for receiving a vehicle body to be repaired thereon and elevated above the surrounding support surface, at least one vertical pull tower means having an arm portion having a top surface and a pair of side surfaces and pivotally connected about a vertical axis fixed to said platform system, said at least one pull tower means being rotatably movable to a desired position relative to said vehicle body, and a step assembly secured to said pull tower arm portion beneath the level of said platform system and above the level of the surrounding support surface for facilitating access by an operator of said apparatus to said platform system, and said step assembly being adapted to fit securely against said top and side surfaces.

2. The apparatus of claim 1 wherein said arm portion has a top surface and a pair of opposing side surfaces and wherein said step assembly is secured to at least one of said pull tower arm portion side surfaces.

3. The apparatus of claim 2 wherein said step assembly is secured to a radially outer portion of said at least one of said pull tower arm portion side surfaces.

4. The apparatus of claim 2 further including a plurality of pull tower means each having a step assembly secured to each of said arm portion side surfaces for facilitating access by an operator of said apparatus to said platform system at different locations around the vehicle body on said platform system.

5. The apparatus of claim 1 wherein said step member is formed of durable plastic.

* * * * *